US011336061B2

(12) United States Patent
Heiskanen et al.

(10) Patent No.: US 11,336,061 B2
(45) Date of Patent: May 17, 2022

(54) SWITCH CONSTRUCTION

(71) Applicants: HUAWEI TECHNOLOGIES CO., LTD., Shenzhen (CN); Juuso Heiskanen, Helsinki (FI); Jari Lamminparras, Helsinki (FI)

(72) Inventors: Juuso Heiskanen, Helsinki (FI); Jari Lamminparras, Helsinki (FI)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 170 days.

(21) Appl. No.: 16/496,976

(22) PCT Filed: Mar. 27, 2017

(86) PCT No.: PCT/EP2017/057212
§ 371 (c)(1),
(2) Date: Sep. 24, 2019

(87) PCT Pub. No.: WO2018/177501
PCT Pub. Date: Oct. 4, 2018

(65) Prior Publication Data

US 2020/0381875 A1 Dec. 3, 2020

(51) Int. Cl.
*H01R 13/707* (2006.01)
*H01H 1/58* (2006.01)
(Continued)

(52) U.S. Cl.
CPC ..... *H01R 13/707* (2013.01); *H01H 1/58* (2013.01); *H01H 13/14* (2013.01); *H01R 13/20* (2013.01);
(Continued)

(58) Field of Classification Search
CPC ..... H01R 13/707; H01R 13/20; H01R 13/70; H01R 13/701; H01H 1/58; H01H 13/14;
(Continued)

(56) References Cited

U.S. PATENT DOCUMENTS 4,189,204 A 2/1980 Brown et al.
9,360,894 B1 6/2016 Lin et al.
(Continued)

FOREIGN PATENT DOCUMENTS

CN 102751123 A 10/2012
CN 104563639 A 4/2015
(Continued)

*Primary Examiner* — Lheiren Mae A Caroc
(74) *Attorney, Agent, or Firm* — Maier & Maier, PLLC

(57) ABSTRACT

A switch assembly includes a switch and a connector. The switch and the connector are configured to interlock, wherein the switch includes a connection extending at least partially along a center axis of the switch, and the connection is configured to receive at least a part of the connector. The connection may include at least one slot and at least one wedge-shaped groove which is extending from the at least one slot and tapered in a direction of the center axis. The connector may include at least one corresponding wedge-shaped protrusion. The at least one corresponding wedge-shaped protrusion may include a resilient contact blade which can interlock with the at least one wedge-shaped groove.

10 Claims, 6 Drawing Sheets

(51) Int. Cl.
*H01H 13/14* (2006.01)
*H01R 13/20* (2006.01)

(52) U.S. Cl.
CPC . *H01H 2203/038* (2013.01); *H01H 2223/002* (2013.01)

(58) Field of Classification Search
CPC ..... H01H 2203/038; H01H 2223/002; H01H 2001/5816; H01H 2225/028; H01H 13/48; H01H 1/5805; H01H 13/00; H01H 13/04; H01H 13/06; H01H 13/12
USPC ..... 200/50.28, 341, 21 r, 302.2, 520, 345
See application file for complete search history.

(56) References Cited

U.S. PATENT DOCUMENTS

| | | | | |
|---|---|---|---|---|
| 9,529,391 | B2 * | 12/2016 | Ely | G06F 1/1656 |
| 10,078,350 | B2 * | 9/2018 | Ely | H01H 9/04 |
| 2005/0272491 | A1 | 12/2005 | Jeon | |
| 2006/0049028 | A1 | 3/2006 | Lu | |
| 2012/0325634 | A1 | 12/2012 | Yang et al. | |
| 2014/0144882 | A1 | 5/2014 | Heller et al. | |
| 2015/0092345 | A1 | 4/2015 | Ely | |
| 2016/0318195 | A1 | 11/2016 | Garavaglia et al. | |
| 2020/0243276 | A1 * | 7/2020 | Heiskanen | H01H 13/7073 |

FOREIGN PATENT DOCUMENTS

| | | | |
|---|---|---|---|
| EP | 2334043 | A1 | 6/2011 |
| FR | 2161388 | A5 | 7/1973 |
| JP | S58117021 | U | 8/1983 |
| JP | S59107170 | U | 7/1984 |
| JP | H0536330 | A | 2/1993 |
| KR | 20150017197 | A | 2/2015 |

* cited by examiner

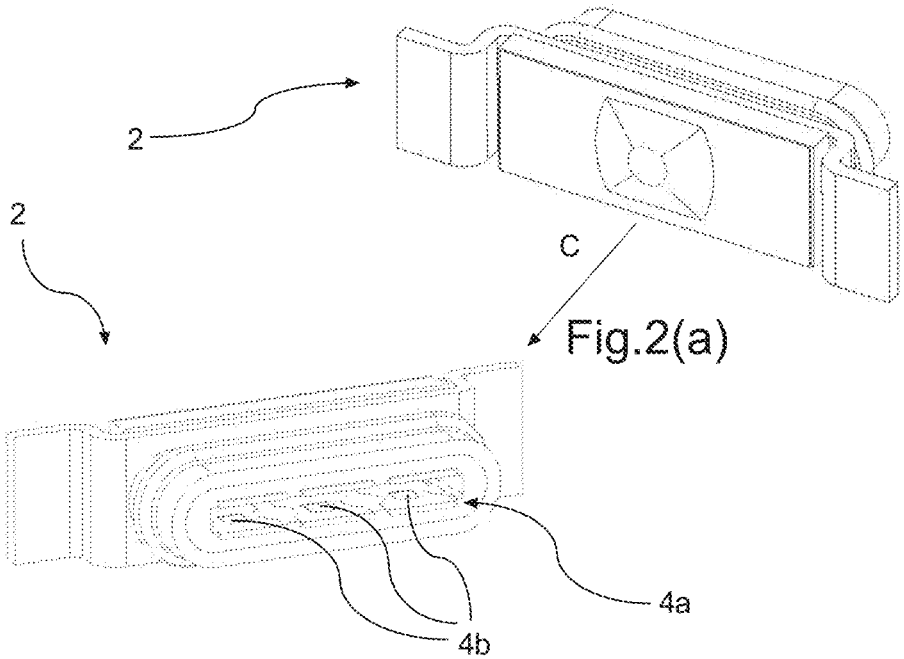
Fig.2(a)
Fig.2(b)
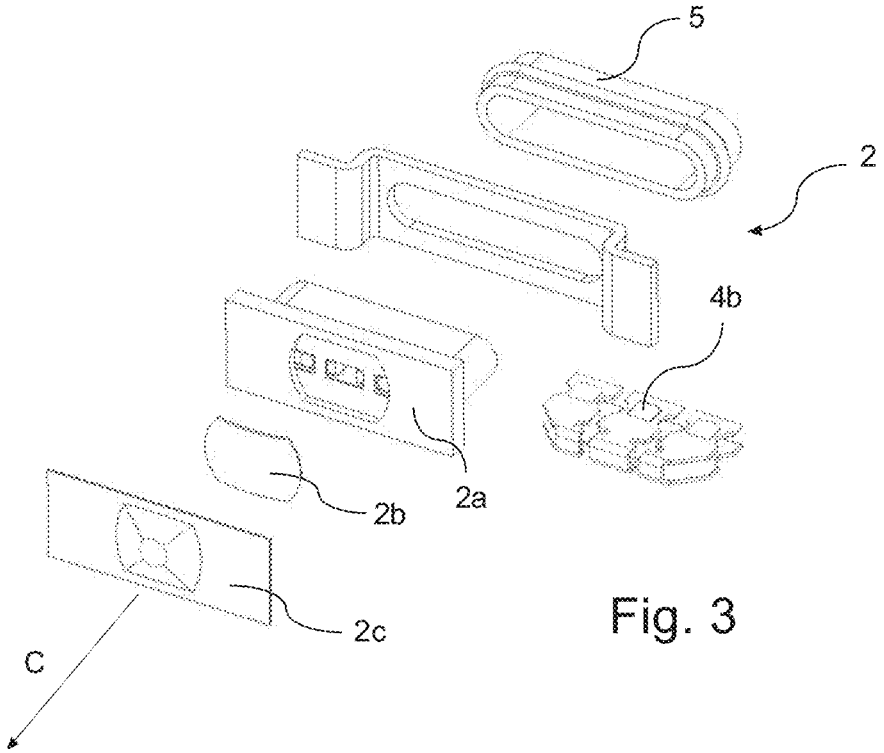
Fig. 3

SWITCH CONSTRUCTION

CROSS-REFERENCE TO RELATED APPLICATIONS

This application is a National Stage of International Application No. PCT/EP2017/057212, filed on Mar. 27, 2017, which is hereby incorporated by reference in its entirety.

FIELD

The disclosure relates to a switch assembly for an electronic device and a button structure including such a switch assembly.

BACKGROUND

The components of electronic devices are designed such that the interior of such a device is protected against ingress of dirt or water, while at the same time being as space, time, and cost efficient as possible to use. For example, push-buttons may be attached to the housing of an electronic device with screws which increases the risk of ingress due to the necessary presence of corresponding screw holes.

An existing solution where the button is connected to a button retainer by interconnecting flanges, allowing the button to move in relation to the button retainer when being pushed by a user, is known. The button retainer is connected to the housing of the electronic device by screws extending from the interior of the housing, and the button is provided with a sealing element.

There are several drawbacks with such a solution. First, manufacture and assembly are time consuming due to the presence of several small components. Secondly, these multiple components all add up to consume significant space. Thirdly, a larger number of components and assembly steps results in large tolerance stack up between the push-button and the other components, impairing the tactile qualities of the push-button.

SUMMARY

It is an object of exemplary embodiments described herein to provide a switch assembly and a button structure which addresses at least some of the drawbacks identified above.

The foregoing and other objects are achieved by the features of the exemplary embodiments and related description and the figures.

According to a first embodiment, there is provided a switch assembly including a switch and a connector, the switch and the connector being configured to interlock, and the switch includes a connection extending at least partially along a center axis of the switch, the connection being configured to receive at least a part of the connector. Such a solution results in quick, yet stable, assembly due to the simple step of only interlocking two main components, i.e. a switch component and a connector component. Fewer pieces and parts also leads to smaller space requirements within the electronic device. Further, tolerance stack up is reduced, and the tactile qualities of the push-button corresponding to the switch assembly are improved.

The center axis C of the switch extends between the opposing free ends the switch body, i.e. in a direction which also corresponds to the center axis of a through-going opening into which the switch assembly is to be mounted.

This may correspond, when the switch assembly is mounted into an electronic device, to the direction of the width of the electronic device. Hence, a first perpendicular axis extends in the direction of the height of the electronic device, and a second perpendicular axis extends in the direction of the thickness of the electronic device. It may also correspond to the direction of the height of the electronic device. In this case, a first perpendicular axis extends in the direction of the width of the electronic device, and a second perpendicular axis extends in the direction of the thickness of the electronic device.

In a first possible implementation form of the first embodiment, the switch cannot be separated from the connector by movement in a direction of the center axis. Hence, a stable connection is maintained, hindering or preventing the switch from separating from the electronic device onto which it has been mounted.

In a second possible implementation form of the first embodiment, the connection includes at least one slot. This solution may utilize significantly less space compared to prior art.

In a third possible implementation form of the first embodiment, the connection further includes at least one wedge-shaped groove extending from the slot, the groove being tapered in the direction of the center axis, and the connector includes at least one corresponding wedge-shaped protrusion. In this manner, the protrusion can be easily inserted into the slot and groove, yet being interlocked such that the connector cannot be easily removed from the switch.

In a fourth possible implementation form of the first embodiment, the protrusion includes a resilient contact blade configured to interlock with the wedge-shaped groove.

In a fifth possible implementation form of the first embodiment, the connection includes at least one pin protruding in the direction of the center axis, the pin including an end section having an increased cross-section, and the connector includes at least one partially open-ended slit, the slit being configured to interlock releasably with the pin end section in a direction which is perpendicular to the center axis, and interlock unreleasably with the pin in the direction of the center axis. In this manner, the connector can be easily, and releasably, connected to the switch.

In a sixth possible implementation form of the first embodiment, crush ribs protrude from a circumference of the switch. This provides a tight fit between the switch and the opening into which it is mounted.

In a seventh possible implementation form of the first embodiment, the connection and/or connector include at least one recess, and the connector and/or slot correspondingly include at least one protrusion, the protrusion being configured to interlock with the recess.

In an eighth possible implementation form of the first embodiment, the switch includes a sealing element configured to at least partially cover a circumference of the switch, allowing the device to be waterproof.

According to a second embodiment, there is provided a button structure for an electronic device, the electronic device including a housing having an external surface and an internal surface, the surfaces being connected by a through-going opening, the button structure including a push-button and a switch assembly according to the above, where the switch is configured to be inserted into the opening in a direction from the external surface, and the connector is configured to be connected to the switch such that the switch assembly is secured to the housing. This is a quick yet stable solution due to the simple step of only interlocking two main components, i.e. a switch component and a connector component. Further, the connector has a dual function of providing electrical connection and of securing the switch to the housing of an electronic device. Fewer pieces and parts leads to smaller space requirements within the electronic device. In addition, tolerance stack up is reduced, and the tactile qualities of the push-button corresponding to the switch assembly are improved.

In a first possible implementation form of the second embodiment, the connector is configured to be arranged at least partly inside a slot extending at least partially along the center axis. This solution consumes significantly less space than prior art.

In a second possible implementation form of the second embodiment, the switch further includes at least one wedge-shaped groove extending from the slot, the groove being tapered in the direction of the center axis, and the connector further includes at least one corresponding wedge-shaped protrusion. This allows the protrusion to be easily inserted into the corresponding slot and groove, yet being interlocked such that the connector cannot be easily separated from the switch.

In a third possible implementation form of the second embodiment, the connector includes a stopper that prevents the button structure from exiting the opening in a direction towards the external surface.

In a fourth possible implementation form of the second embodiment, crush ribs protrude from a circumference of the switch, the crush ribs being configured to provide a tight fit between the switch and the opening.

In a fifth possible implementation form of the second embodiment, the connector is configured to be arranged outside of the opening, in abutment with the internal surface.

In a sixth possible implementation form of the second embodiment, the switch includes at least one pin protruding in the direction of the center axis, the pin includes an end section having an increased cross-section, and the connector includes at least one partially open-ended slit, the slit being configured to interlock releasably with the pin in a direction which is perpendicular to the center axis, and interlock unreleasably with the pin in the direction of the center axis. This way, the connector can be easily, and releasably, connected to the switch.

In a seventh possible implementation form of the second embodiment, the button structure further includes a compressive element arranged between the internal surface and the connector. The compressive element provides a constant force on the connector and hence the switch in a direction inward towards the interior of the electronic device.

According to a third embodiment, there is provided an electronic device configured to receive a button structure according to the above, the electronic device including a housing having an external surface and an internal surface, the surfaces being connected by a through-going opening, the button structure includes a switch and a connector, the switch being configured to be inserted into the through-going opening, and the connector being configured to interlock with the switch such that the switch cannot be separated from the connector by movement in a direction out of the through-going opening. This solution reduces the tolerance stack up between push-button and switch, hence improving the tactility of the push-button even if the push-button is not perfectly centered with the switch.

In a first possible implementation form of the third embodiment, the switch includes a slot and at least one wedge-shaped groove extending from the slot, and the connector includes at least one resilient contact blade configured to interlock with the wedge-shaped groove. This allows the switch to be easily connected to the connector, yet interlocking the two such that they cannot be easily separated.

In a second possible implementation form of the third embodiment, the switch includes at least one pin provided with an end section having an increased cross-section, and the connector includes at least one partially open-ended slit, the slit being configured to interlock releasably with the pin end section in a direction which is perpendicular to the through-going opening. This way, the connector can be easily, and releasably, connected to the switch.

According to a fourth embodiment, there is provided a method of providing an electronic device with a button structure according to the above, the electronic device including a housing having an external surface and an internal surface, the surfaces being connected by a through-going opening, the method including the steps of connecting the push-button to the switch, inserting the switch into the opening, in a direction from the external surface, connecting the connector to the switch such that the switch cannot be separated from the connector by movement in a direction of the opening. Such as method results in quick yet stable assembly due to the simplicity of only interlocking two main components, i.e. a switch component and a connector component.

In a first possible implementation form of the fourth embodiment, another step includes inserting the connector into the slot extending within the switch, in a direction from the internal surface, the connector interlocking with the slot such that the switch cannot be removed from the opening. This allows the switch to be easily connected to the connector, yet interlocking the two such that they cannot be easily separated.

In a second possible implementation form of the fourth embodiment, another step includes interlocking the at least one slit and at least one pin, in a direction which is perpendicular to the opening, such that the connector abuts the internal surface and the switch cannot be removed from the opening without removing the connector from the housing. This way, the connector can be easily, and releasably, connected to the switch.

These and other aspects will be apparent from and the embodiments described below.

BRIEF DESCRIPTION OF THE DRAWINGS

In the following detailed portion of the present disclosure, the aspects, embodiments and implementations will be explained in more detail with reference to the example embodiments shown in the drawings, in which:

FIG. 2*a* shows an elevated front view of a switch in accordance with another embodiment;

FIG. 2*b* shows an elevated rear view of the embodiment shown in FIG. 2*a;*

FIG. 3 shows an exploded and elevated view of the embodiment shown in FIG. 2*a;*

DETAILED DESCRIPTION

Figure 1A:
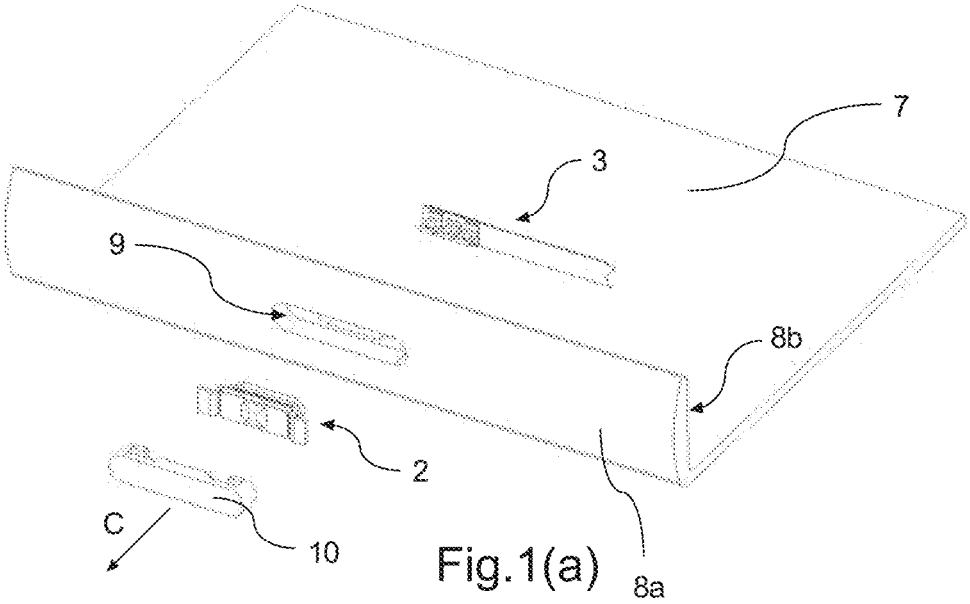
FIG. 1*a* shows an exploded and elevated view of a button structure and a partial housing in accordance with one embodiment.
Figure 1B:
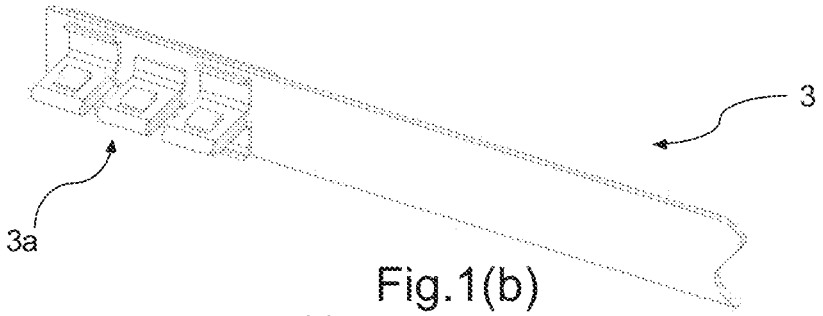
FIG. 1*b* shows an elevated view of a connector in accordance with one embodiment.
Figure 1C:
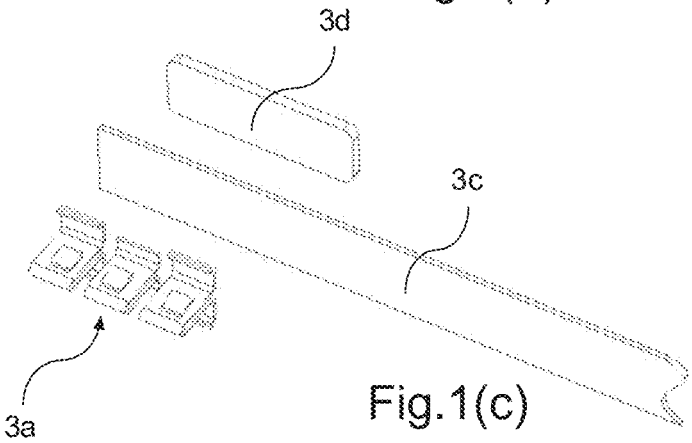
FIG. 1*c* shows an exploded and elevated view of the embodiment shown in FIG. 1*b;*
Figure 4A:
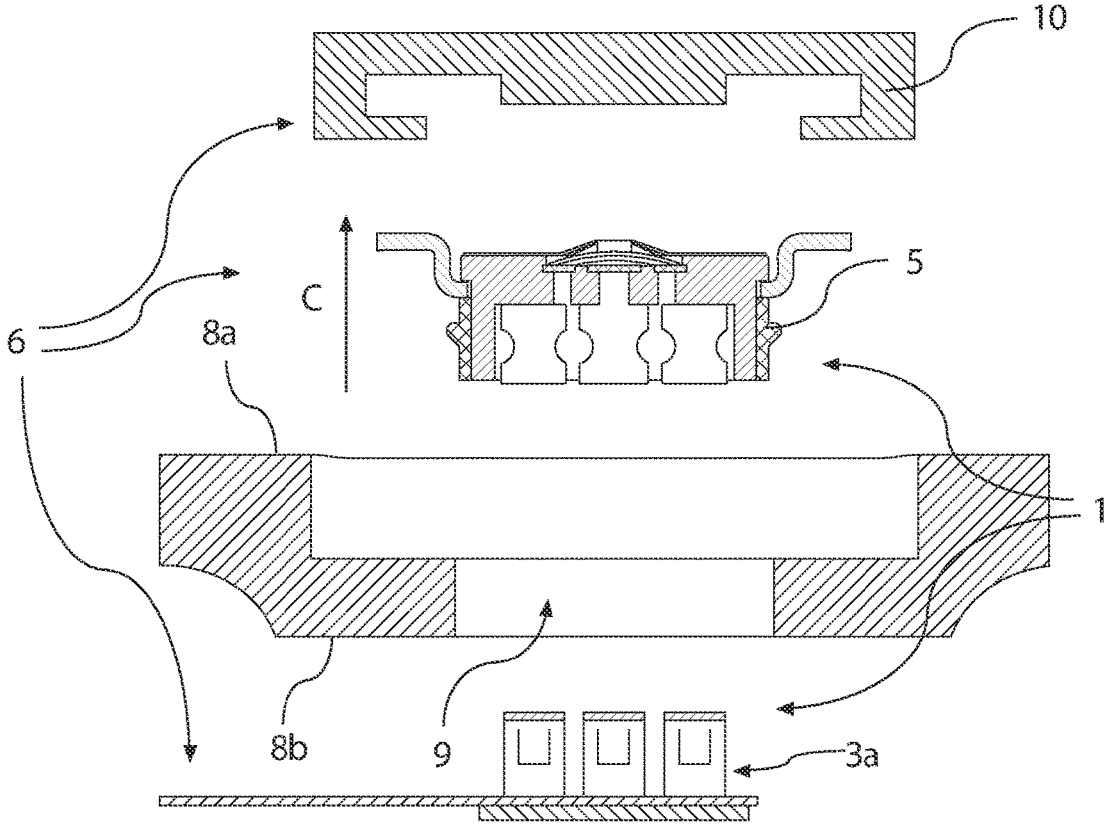
FIG. 4*a* shows a cross-sectional view of the button structure and housing shown in FIG. 1*a*, with the button structure separated from the housing.
Figure 4B:
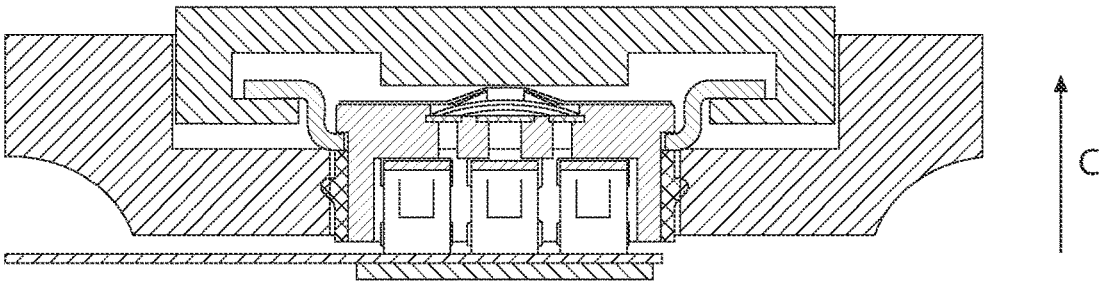
FIG. 4*b* shows a cross-sectional view of the button structure and housing shown in FIG. 4*a*, with the button structure inserted into an opening in the housing.

FIG. 1 shows an embodiment including a section of the housing 7 of an electronic device, a switch assembly 1 including a switch 2 and a connector 3, and a push-button 10. The components are adapted for being mechanically connected, and the switch 2 is also adapted for being electrically connected to the connector 3. This will be described in more detail below.

Figure 7A:
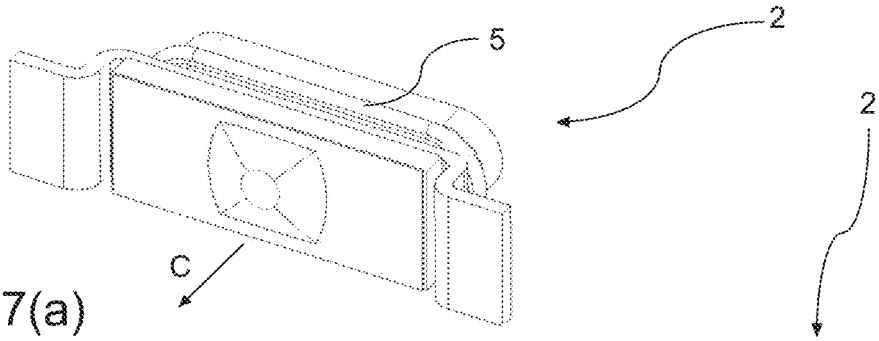
FIG. 7*a* shows an elevated front view of the switch of the embodiment shown in FIG. 6.

FIGS. 2, 3, and 7 show embodiments of a switch where the switch includes a switch body 2*a*, a switch contact 2*b*, and a switch contact cover 2*c*. The switch may also include sealing element 5.

In one embodiment, the sealing element 5 is configured to at least partially cover the circumference of the switch 2. The sealing element 5 may include a gasket with a circumferentially extending ridge. The sealing element/gasket 5 may be a separate rubber component, or may be molded directly onto the switch body 2*a*, for example the second switch body section, by liquid injection molding.

The switch body 2*a* includes aplastic material and is, for example, manufactured by insert molding. The switch body 2*a* includes of two sections, a first switch body section and a second switch body section, arranged along the center axis C of the switch body 2*a*.

In one embodiment, the first switch body section has a cross-section which is larger than that of the second switch body section. That is, a side cross-sectional view of the switch reveals an essentially T-shaped switch body 2*a*, while a frontal or rear cross-sectional view reveals one or two essentially rectangular surface areas, depending on if the cut has been made through the first switch body section or the second switch body section.

The switch contact 2*b*, in one embodiment including a dome, is configured to be arranged in a slot arranged at the free end of the first switch body section. A switch contact cover 2*c* is provided to cover the switch contact/dome 2*b* and the slot, for example by laser welding or adhering the switch contact cover 2*c* to the above mentioned free end.

The switch assembly 1 includes a switch 2 and a connector 3 configured to interlock. The switch 2 includes connection 4 extending at least partially along a center axis C of the switch, and the connection 4 is configured to receive at least a part of the connector 3.

Figure 6:
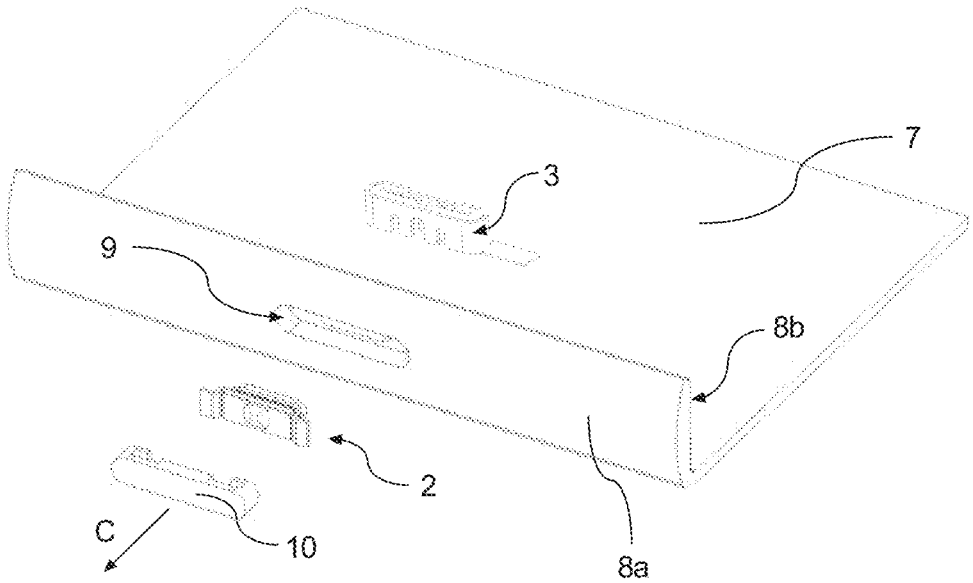
FIG. 6 shows an exploded and elevated view of a button structure and a partial housing in accordance with yet another embodiment.

The center axis C of the switch 2 extends between the switch contact cover 2*c* and the free end of the second switch body, i.e. in a direction which corresponds to the center axis of the through-going opening 9 in the housing 7. This corresponds, when the switch assembly is mounted into an electronic device, to the direction of the width of the electronic device. A first perpendicular axis extends in the direction of the height of the electronic device, and a second perpendicular axis extends in the direction of the thickness of the electronic device. FIGS. 1 and 6 show the thickness of the electronic device, while only sections of the height and width.

In one embodiment, the switch 2 is provided with crush ribs protruding from the circumference of the switch 2.

In one embodiment, the switch 2 cannot be separated from the connector 3 by movement in the direction of the center axis C. That is, once the switch 2 and the connector 3 have been connected, the switch 2 cannot be detached from the connector 3 by pulling them in opposite directions. The connection 4 and/or connector 3 include at least one recess, and the connector 3 and/or connection 4 correspondingly includes at least one protrusion, the protrusion being configured to interlock with the recess.

In one embodiment, the connection 4 extends along the center axis C of the switch 2, at least through the second section of the switch body 2*a*. The connection 4 is configured to extend all the way up until the switch contact/dome 2*b*, such that the switch contact can interact with the connector 3 by way the above mentioned electrical connection.

Figure 5A:
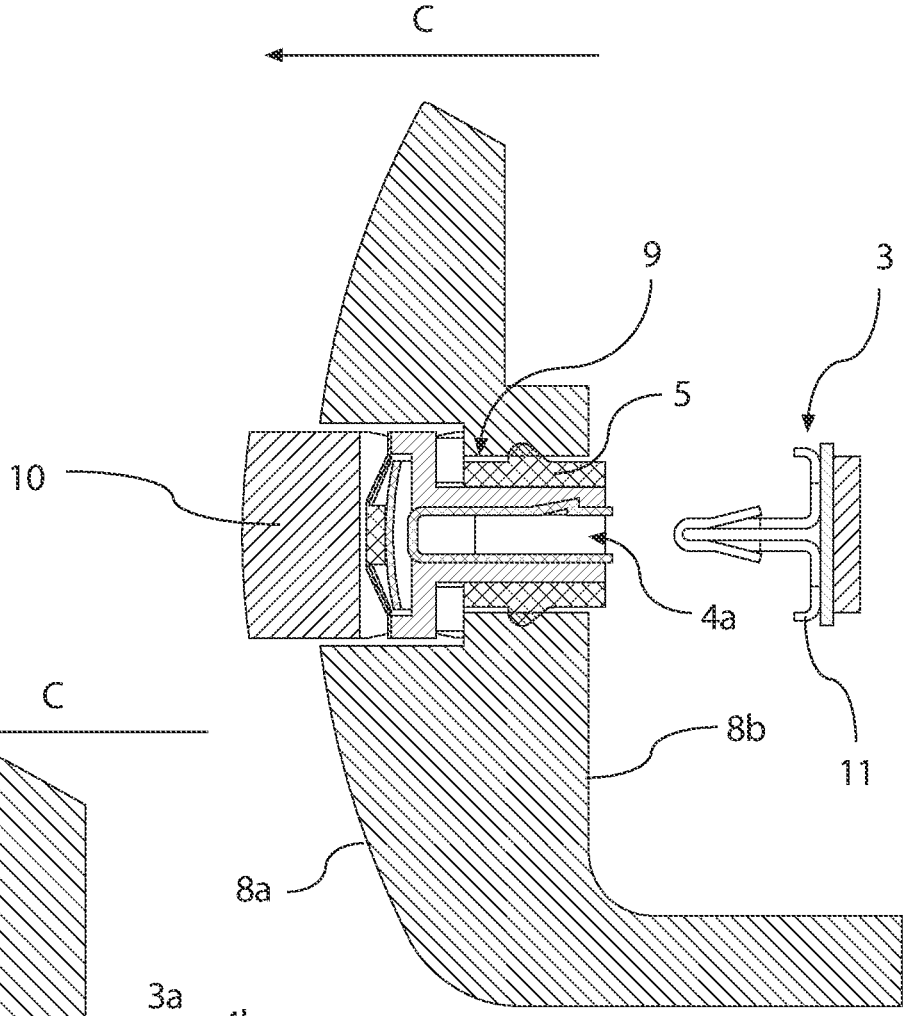
FIG. 5*a* shows a further cross-sectional view of the button structure and housing shown in FIG. 1*a*, with the connector separated from the switch and housing.
Figure 5B:
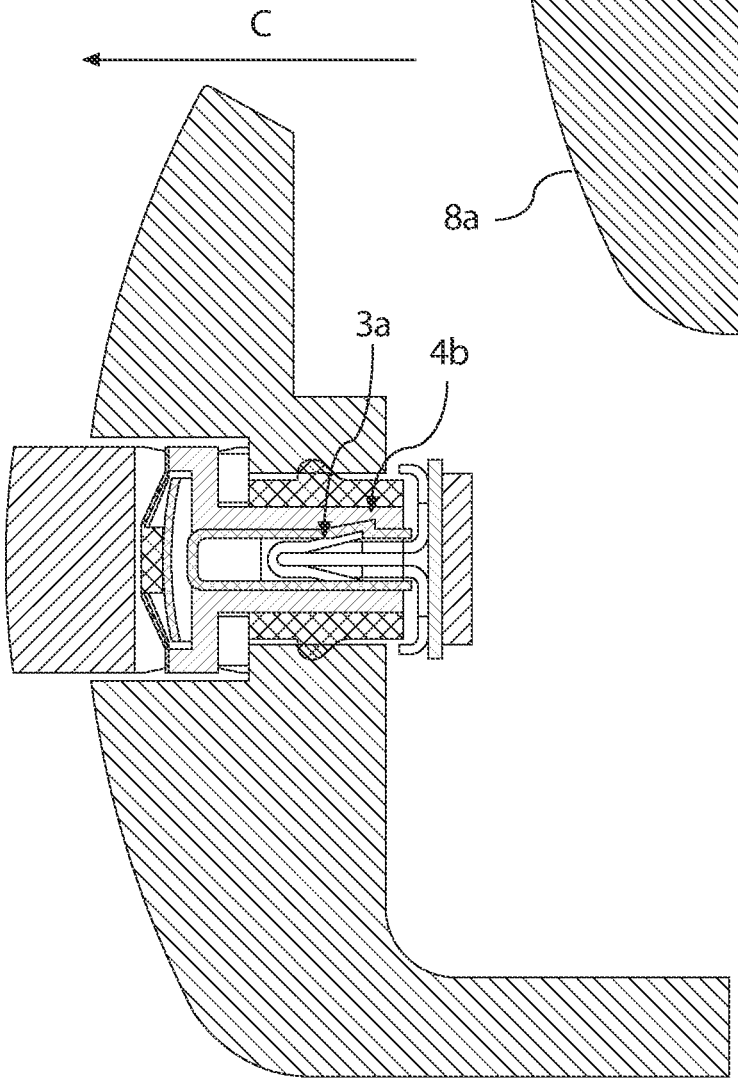
FIG. 5*b* shows a cross-sectional view of the button structure and housing shown in FIG. 5*a*, with the connector inserted into the switch.

In one embodiment, the connection 4 includes at least one slot 4*a*, seen in FIG. 2*b*. The connection 4 further includes at least one wedge-shaped groove 4*b* extending from the slot 4*a*. See FIGS. 5*a* and 5*b*. The groove 4*b* is tapered in the direction of the center axis C. More specifically, the depth of the groove, in a direction perpendicular to the center axis C, is at its largest at the section which is farthest from the switch contact 2*b* and eventually the push-button 10. That is, the wedge declines in the direction from the second switch body section towards the first switch body section.

The connector 3 includes at least one corresponding wedge-shaped protrusion 3*a*, soldered onto a flex 3*c*. A flex stiffener 3*d* is connected to the flex 3*c* in order to keep the connector 3 stiff or rigid when connected to the switch 2. In one embodiment, the protrusion 3*a* includes a resilient contact blade configured to interlock with the wedge-shaped groove 4*b*. This way, the connector/contact blade 3 can be easily inserted into the slot 4*a* and groove 4*b*, while being interlocked such that the connector/contact blade 3 cannot be easily removed from the slot 4*a* and groove 4*b*. The resilient contact blade may have a stamped metal blade. The switch body 2*a* may be insert molded onto the stamped metal blade(s).

In a further embodiment shown in FIGS. 6 and 7, the connection 4 includes at least one pin 4*c* protruding in the direction of the center axis C. That is, the center axis of the switch and the center axis of the pin extend in parallel. The pin extends at least through the second section of the switch body 2*a*, and partially into the first section of the switch body 2*a*. The pin 4*c* is configured to extend all the way up until the switch contact/dome 2*b*, such that the switch contact can interact with the connector 3 by the above mentioned electrical connection.

Figure 7B:
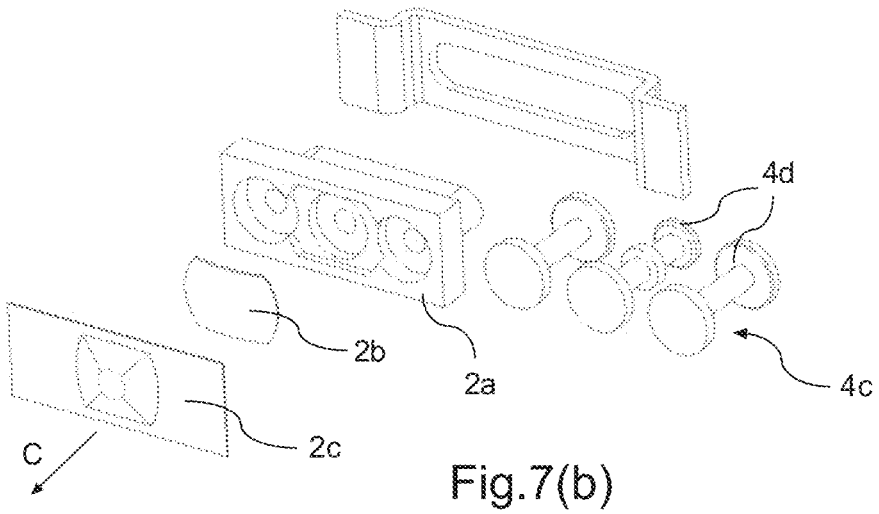
FIG. 7*b* shows an exploded and elevated view of the embodiment shown in FIG. 7*a;*

In one embodiment, the pin 4*c* includes an end section 4*d* having an increased cross-section. The pin may include a further, oppositely arranged end section also having an increased cross-section, as seen in FIG. 7*b*. The pin 4*c*, can, for example, include an insert molded metal pin.

Figure 8:
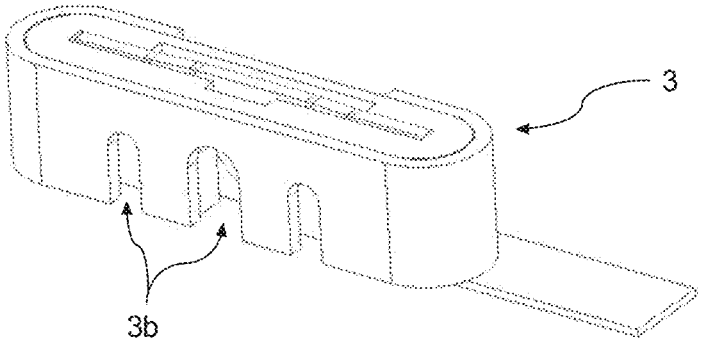
FIG. 8 shows an elevated rear view of a connector in accordance with the embodiment shown in FIG. 6.
Figure 9:
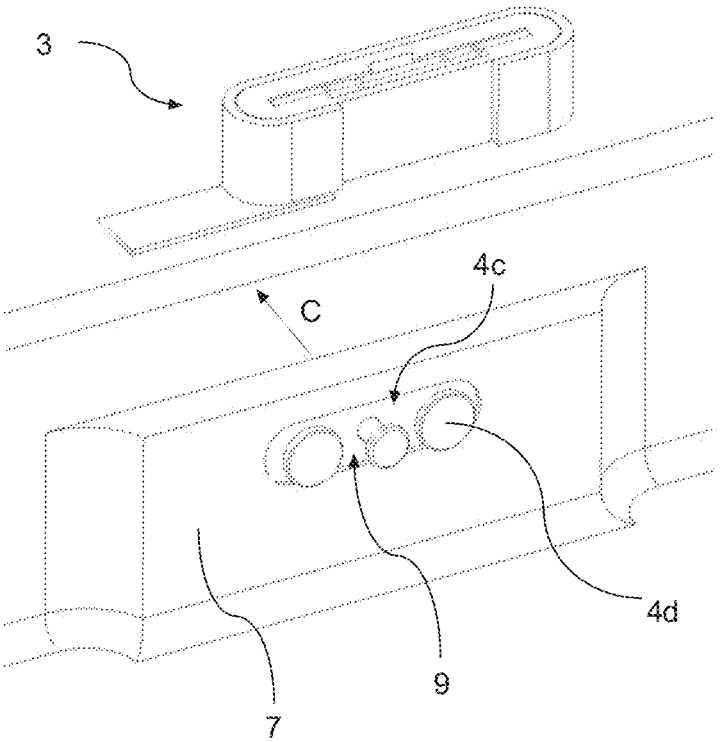
FIG. 9 shows an elevated view of the button structure and a partial housing shown in FIG. 6, with the connector separated from the switch and housing, and seen from inside the housing.

As shown in FIGS. 6 and 8, this embodiment includes a connector 3 having at least one partially open-ended slit 3*b*. The slit 3*b* is configured to interlock releasably with the pin end section 4*d* in a direction which is perpendicular to the center axis C, while at the same time interlocking unreleasably with the pin 4*c* in the direction of the center axis C. That is, the slit 3*b* has an opening at one end, while being closed at the other end, such that the slit essentially has an upside-down U-shape. The interior of the slit has larger dimensions such that it can receive the end section 4*d* of the pin. The external section of the slit, the section facing and abutting the switch when mounted, has smaller dimensions adapted for accommodating only the smaller middle section of the pin 4*c*. The dimensions of the external section of the slit are, in other words, smaller than the dimensions of the pin end section 4*d*.

Hence, the slit 3*b* is adapted for being slid over the end section 4*d* of the pin 4*c* in a direction perpendicular to the center axes of the switch and the pin(s). The switch 2/pin 4*c* cannot be separated from the connector 3/slit 3*b* by movement in the direction of the center axis C. That is, once the switch 2 and the connector 3 have been connected, the switch 2/pin 4*c* cannot be detached from the connector 3/slit 3*b* by pulling them in opposite directions. However, the switch 2/pin 4*c* can be separated from the connector 3/slit 3*b* by sliding the connector 3/slit 3*b* in a direction perpendicular to the center axes of the switch 2 and the pin(s) 4*c*, but opposite to the direction used when connecting the slit 3*b* and pin 4*c*.

FIGS. 1, 4, 6, and 9 show embodiments of a button structure 6 arranged in an electronic device such as a mobile phone. The electronic device includes a housing 7 having an external surface 8*a* and an internal surface 8*b* connected by a through-going opening 9. The button structure 6 includes a push-button 10 and an embodiment of the above-mentioned switch assembly 1. The switch 2 is configured to be inserted into the through-going opening 9 in a direction from said external surface 8*a* towards the internal surface 8*b*. The connector 3 is configured to be connected to the switch 2 such that the switch assembly 1 is secured to the housing 7.

In one embodiment, the connector 3 is configured to be arranged at least partly inside the slot 4*a* extending at least partially along the center axis C of the switch 2. As mentioned above, the switch may further include at least one wedge-shaped groove 4*b* extending from the slot 4*a*, the groove 4*b* being tapered in the direction of the center axis C, and the connector 3 includes at least one corresponding wedge-shaped protrusion 3*a*.

The connector 3 may include stopper 11 preventing the assembled button structure 6 from exiting the opening 9 in a direction towards the external surface 8*a*. That is, the stopper 11 has dimensions which are at least partially larger than the dimensions of the slot 4*a*.

As mentioned above, the switch 2 may be provided with crush ribs protruding from the circumference of the switch 2. The crush ribs are configured to provide a tight fit between the exterior of the switch 2 and the interior of the opening 9.

In a further embodiment, the connector 3 is configured to be arranged outside of the opening 9, in abutment with the internal surface 8*b*. This embodiment includes a switch 2 provided with at least one pin 4*c* protruding in the direction of the center axis C. As mentioned above, the pin 4*c* includes an end section 4*d* having an increased cross-section, and the connector 3 includes at least one partially open-ended slit 3*b*. The slit 3*b* is configured to interlock releasably with the pin 4*c* in a direction which is perpendicular to the center axis C, and interlock unreleasably with the pin 4*c* in the direction of the center axis C.

In one embodiment, the button structure 6 further includes a compressive element arranged between the internal surface and the connector, for example a gasket. The compressive element may be made of rubber or a foam material. The compressive element is compressed between internal surface 8*b* and connector 3, hence providing a constant force on the connector 3, and hence the switch 2, in a direction inward towards the interior of the electronic device.

FIGS. 1 and 6 show embodiments of an electronic device configured to receive the above-mentioned button structure 6. The electronic device includes a housing 7 having an external surface 8*a* and an internal surface 8*b*, the surfaces 8*a*, 8*b* being connected by a through-going opening 9. The button structure 6 includes a switch 2 and a connector 3. The switch 2 is configured to be inserted into the through-going opening 9, and the connector 3 is configured to interlock with the switch 2 such that the switch 2 cannot be separated from the connector 3 by movement in a direction out of the through-going opening 9.

In one embodiment, the switch 2 includes a slot 4*a* and at least one wedge-shaped groove 4*b* extending from the slot 4*a*, and the connector 3 includes at least one resilient contact blade 3*a* configured to interlock with the wedge-shaped groove 4*b*.

In a further embodiment, the switch 2 includes at least one pin 4*c* provided with an end section 4*d* having an increased cross-section, and the connector 3 includes at least one partially open-ended slit 3*b*. The slit 3*b* is configured to interlock releasably with the pin end section 4*d* in a direction which is perpendicular to the through-going opening 9.

In one embodiment, the electronic device is provided with a button structure 6 by the following steps. First, the push-button 10 is connected to the switch 2. In one embodiment, this is done in a direction which is perpendicular to the center axis C of the switch 2. Secondly, the switch 2 is inserted into the opening 9, in a direction from the external surface 8*a*. Thirdly, the connector 3 is connected to the switch 2 such that the switch 2 cannot be separated from the connector 3 by movement in the direction of the opening 9.

In one embodiment, the third step includes inserting the connector 3 into the slot 4*a* extending within the switch 2, in a direction from the internal surface 8*b*, and the connector 3 interlocking with the slot 4*a* such that the switch 2 cannot be removed from the opening 9.

In a further embodiment, the third step includes interlocking the at least one slit 3*b* and at least one pin 4*c*, in a direction which is perpendicular to the opening 9, such that the connector 3 abuts the internal surface 8*b* and the switch 2 cannot be removed from the opening 9 without removing the connector 3 from the housing 7.

The various aspects and implementations have been described in conjunction with various embodiments herein. However, other variations to the disclosed embodiments can be understood and effected by those of ordinary skill in the art in practicing the claimed subject-matter, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. An electronic device comprising:

a housing having an external surface and an internal surface, the external surface and the internal surface being connected by a through-going opening; and a button assembly, the button assembly comprising:

a switch inserted into the through-going opening in a direction from the external surface;

a connector interlocked with the switch such that the button assembly is secured to the housing; and a push button connected to the switch;

wherein the switch comprises a connection extending along a center axis of the switch, the connection receiving at least a part of the connector; and the connection comprises at least one slot, at least one wedge-shaped groove extending from the at least one slot, the at least one wedge-shaped groove tapered in a direction of the center axis; the connector further comprises at least one corresponding wedge-shaped protrusion; and the at least one corresponding wedge-shaped protrusion comprises a resilient contact blade, and the resilient contact blade interlocks with the at least one wedge-shaped groove.

2. The electronic device of claim 1, wherein the connection comprises at least one pin protruding in the direction of the center axis, the at least one pin comprising an end section having an increased cross-section, and the connector further comprises at least one partially open-ended slit;

wherein the at least one partially open-ended slit interlocks releasably with the at least one pin end section in a direction which is perpendicular to the center axis, and the at least one partially open-ended slit interlocks unreleasably with the at least one pin in the direction of the center axis.

3. The electronic device of claim 1, wherein the switch further comprises a sealing gasket at least partially covering a circumference of the switch.

4. The electronic device of claim 1, wherein the connector further comprises a stopper that prevents the button assembly from exiting the through-going opening in a direction towards external surface.

5. The electronic device of claim 1, wherein the connector is arranged outside of the through-going opening, in abutment with the internal surface.

6. A button assembly for an electronic device, comprising:

a switch configured to be inserted into a through-going opening of a housing of the electronic device;

a connector configured to interlock with the switch such that the button assembly is secured to the housing; and a push button connected to the switch;

wherein the switch comprises a connection extending along a center axis of the switch and the connection receives at least a part of the connector, the connection comprises at least one slot, at least one wedge-shaped groove extending from the at least one slot, the at least one wedge-shaped groove being tapered in a direction of the center axis, the connector further comprises at least one corresponding wedge-shaped protrusion, and the at least one corresponding wedge-shaped protrusion comprises a resilient contact blade, and the resilient contact blade interlocks with the at least one wedge-shaped groove.

7. The button assembly of claim 6, wherein the connector further comprises at least one partially open-ended slit;

the connection further comprises at least one pin protruding in the direction of the center axis, the at least one pin comprising an end section having an increased cross-section, and the at least one partially open-ended slit is configured to interlock releasably with the at least one pin end section in a direction which is perpendicular to the center axis, and the at least one partially open-ended slit is configured to interlock unreleasably with the at least one pin in the direction of the center axis.

8. The button assembly of claim 6, wherein the connector further comprises a stopper preventing the button assembly from exiting the through-going opening.

9. The button assembly of claim 6, further comprising a compressive gasket configured to be arranged in the through-going opening.

10. A method of providing an electronic device with a button assembly, the electronic device comprising a housing having an external surface and an internal surface, the external surface and the internal surface connected by a through-going opening, the button assembly comprising a push-button, a switch and a connector, the switch comprising a connection extending along a center axis of the switch, the connection receiving at least a part of the connector;

the method comprising:

a) connecting the push-button to the switch, b) inserting the switch into the through-going opening, in a direction from the external surface, c) connecting the connector to the switch such that the switch cannot be removed from the through-going opening;

wherein connecting the connector to the switch such that the switch cannot be removed from the through-going opening further comprises:

inserting the connector into a slot extending within the switch, in a direction from the internal surface, and interlocking the connector with the slot, wherein the connector further comprises at least one partially open-ended slit, the connection further comprising at least one pin protruding in a direction of the center axis, the at least one pin comprising an end section having an increased cross-section;

and wherein connecting the connector to the switch such that the switch cannot be removed from the through-going opening further comprises:

interlocking the at least one partially open-ended slit and the at least one pin, in a direction which is perpendicular to said through-going opening;

wherein the at least one partially open-ended slit is configured to interlock releasably with the at least one pin end section in a direction which is perpendicular to the center axis, and the at least one partially open-ended slit is configured to interlock unreleasably with the at least one pin in the direction of the center axis.

* * * * *